United States Patent [19]

Ebert et al.

[11] Patent Number: 4,488,684

[45] Date of Patent: Dec. 18, 1984

[54] PRECISION LIQUID COATING APPARATUS FOR AN ELECTROLYTIC PRINTER

[75] Inventors: William S. Ebert; Harold D. Reynolds, both of Endicott, N.Y.; William J. Sjostrom, Rome, Pa.; Robert R. Strollo, Endicott, N.Y.

[73] Assignee: International Business Machines Corporation, Armonk, N.Y.

[21] Appl. No.: 454,304

[22] Filed: Dec. 29, 1982

[51] Int. Cl.[3] ..... B05B 3/02

[52] U.S. Cl. ..... 239/222; 239/246

[58] Field of Search ..... 239/222, 246, 380, 231, 239/232, 504, 524, 225, 214

[56] References Cited

U.S. PATENT DOCUMENTS

| | | | |
|---|---|---|---|
| 2,602,016 | 7/1952 | Goldsmith | 346/76 |
| 2,994,482 | 8/1961 | Valois et al. | 239/225 |
| 3,749,313 | 7/1973 | Weitmann | 239/222 |
| 3,880,357 | 4/1975 | Baisch | 239/380 |
| 3,890,622 | 6/1975 | Alden | 346/74 E |
| 3,974,041 | 8/1976 | Haruta | 204/2 |
| 4,335,967 | 6/1982 | Pawletko | 400/119 |

*Primary Examiner*—John J. Love
*Assistant Examiner*—James R. Moon, Jr.
*Attorney, Agent, or Firm*—Saul A. Seinberg

[57] ABSTRACT

Apparatus for effecting controlled and accurate moistening of an object is described. A hollow rotor is provided with at least one shaped portion in its surface, that portion having a row of nozzles therein. The nozzles are drilled completely through the rotor sidewall so that they comprise a conduit between the rotor's center and the outer surface of the rotor. An apertured plate and shutter plate are movably mounted between an object to be coated and the rotor. Fluid is delivered to the center of the rotor from a supply thereof by means of an inlet tube. The rotor is coupled at its other end, which is sealed to prevent fluid escape, to a motor and driven thereby to eject fluid from the nozzles, aided by the vacuum effect of the shaped rotor portion. Only that fluid escaping through the exposed section of the slot in the apertured plate strikes and thereby coats the object to be moistened. Movement of the shutter plate can be used to incrementally adjust the width and number of layers of fluid applied to the moistened object.

9 Claims, 2 Drawing Figures

FIG. 2
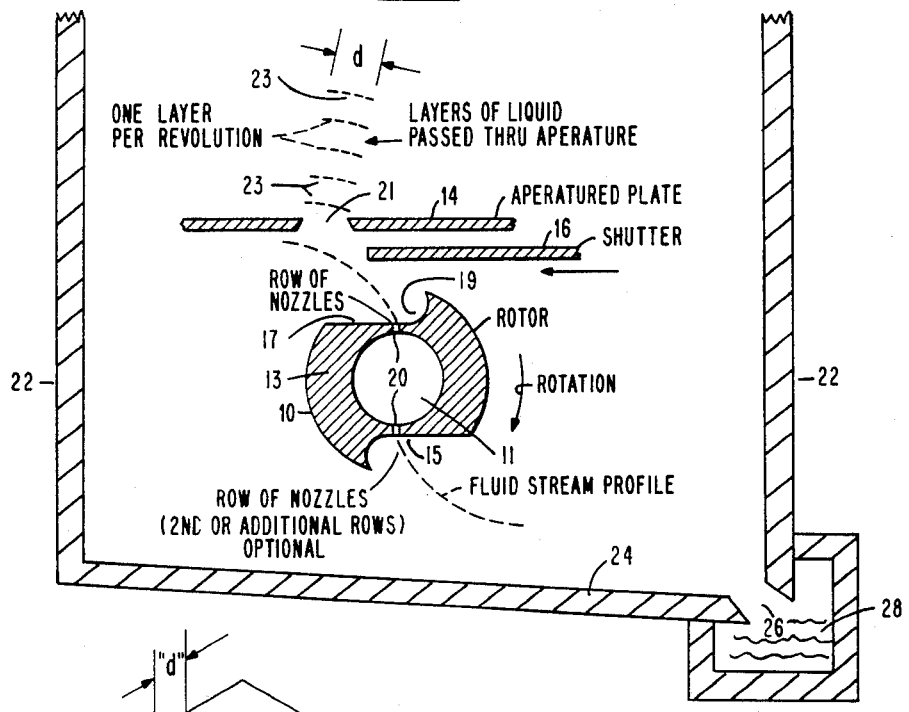
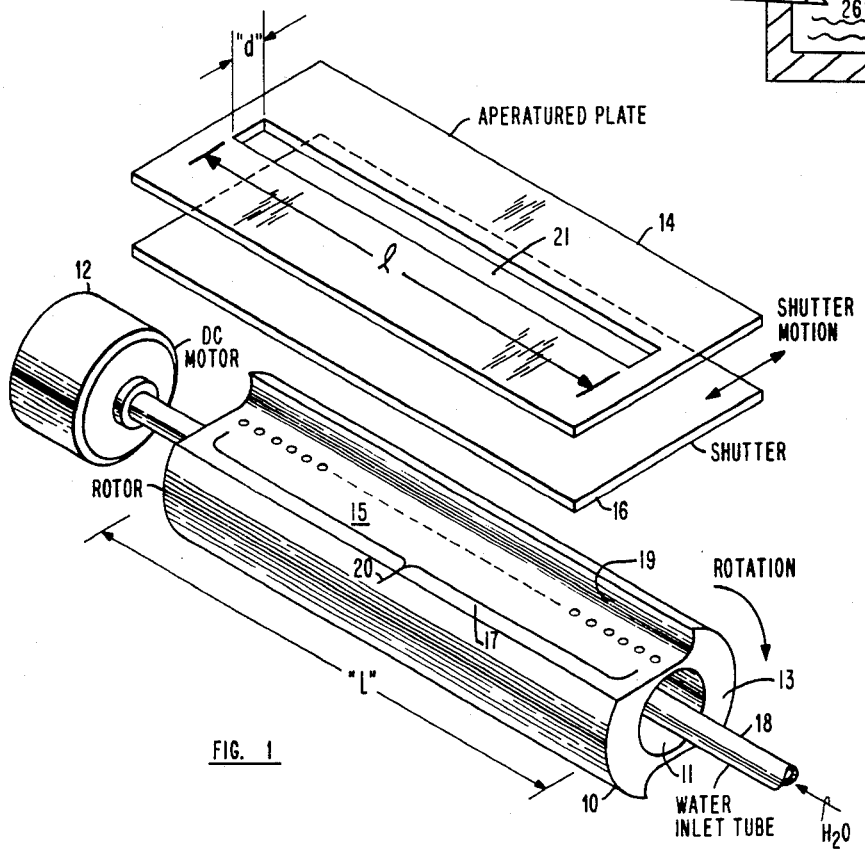
FIG. 1

PRECISION LIQUID COATING APPARATUS FOR AN ELECTROLYTIC PRINTER

BACKGROUND OF THE INVENTION

1. Field of the Invention

This invention is concerned with apparatus for applying moisture to an object in predetermined incremental amounts. More particularly, this invention is directed to apparatus for applying incremental quantities of fluid to the printable surface of a recording medium in an electrolytic printer.

2. Description of the Prior Art

The concept of electrically generated printing has sparked interest since the 1840's. Most attempts at utilizing an electrically initiated printing reaction required relatively high voltages, in the order of 100 to 250 volts, saturated or partially wetted paper and/or consumable electrodes. It was also necessary to employ a recording medium which would be suitable for the particular printing system being used. Almost all of the prior art systems relied on either relatively high amplitude voltage pulses to achieve "dry" or "wet" printing. As might be expected, there were also hybrid systems and recording mediums therefor that attempted to reconcile and/or compensate for the disadvantages of both the dry and wet approaches. However, as is the case with most compromise situations, these hybrid systems were either too expensive to commercially implement or unsatisfactory in performance.

Various efforts were made to improve different aspects of the prior art electrically induced printing systems. Such efforts led to the use of electrolytic based printers wherein relatively low voltages, on the order of no more than 25 volts, are employed to effect printing. One printing system that functions at low energy printing levels, of a magnitude that is compatible with today's densely populated integrated circuit chips, is described in the commonly assigned U.S. patent application Ser. No. 237,560 filed on Feb. 24, 1981 in the name of Bernier et al. In this arrangement, a leuco dye resident in or applied to the surface of the recording medium used therein is rendered visible by the application of a low energy pulse thereto providing that the surface layer thickness of the recording medium, the contact surface area of the print electrodes and the spacing therebetween are all set to predetermined values.

It has been found that the use of electrical pulses to effect printing is substantially aided by moistening the surface layer of the recording medium, particularly in printers using pulses at low energy levels. U.S. Pat. No. 2,602,016 to Goldsmith sought to obtain an enhanced conditioning effect on the recording medium by applying steam thereto. In U.S. Pat. No. 3,890,622 to Alden, a premoistened recording medium is held in a sealed dispensing cassette until needed, thereby conserving moisture. Another strategy is evident in U.S. Pat. No. 3,974,041 to Haruta et al where zeolitic or moisture containing compounds are included within the surface layer of a recording medium, the moisture being liberated by the application of the print signal to the recording medium surface. Another, and more typical approach, is illustrated by the apparatus described in commonly assigned U.S. Pat. No. 4,335,967 to Pawletko where liquid is applied to the treated surface of a recording medium by a direct contact roller implemented applicator.

While operation of all electrically based printers, especially those using low energy pulses, would benefit from using one type or another of the prior art moistening approaches to improve recording medium conductivity and thereby lower energy requirements, these approaches would not be satisfactory for use in the Bernier et al type arrangement explained above for several reasons. The use of steam or other vapor would require additional energy and be incompatible with current printing systems. Further, unless careful handled, heated vapors would tend to pucker or mar the appearance of the final print copies. The use of a cassette or similar device to retain a quantity of premoistened recording medium suffers from its need to use a special and more expensive container that would also limit thruput speed. In addition, the degree to which the wetness of the premoistened recording medium held in the cassette was compatible with current operating conditions might require operator intervention in any event. The use of zeolytic compounds in the surface layer of the recording medium also suffers from most of the above-noted disadvantages. Such treatment of the recording medium would make it more expensive than the treated media now utilized, while still not guaranteeing that the moisture it produced would be commensurate with a given set of operating conditions. The direct roller application approach suffers from a potential contamination defect where any liquid returned to its reservoir may include some of the materials used to treat the surface layer of the recording medium. Lastly, all of the forgoing prior art approaches, in varying degrees over time under differing operating conditions, are unable to repeatedly apply accurate amounts of moisture at the exact locations where such moisture would be required.

OBJECTS AND SUMMARY OF THE INVENTION

Accordingly, it is a principal object of the present invention to provide apparatus for applying moisture to the surface layer of a recording medium in an electrical based printer.

It is also a principal object of the present invention to provide such apparatus, which can be adjusted, to apply moisture in a precise and predictable manner to an object.

It is another object of the present invention to provide such moistening apparatus which can perform its intended function without danger of contaminating its own liquid supply and without the need to contact the object to be moistened.

It is an additional object of the present invention to provide such moistening apparatus that will provide moisture to the surface of a recording medium in a manner that maximizes wetting and penetration thereof.

These and other objects of the present invention are achieved by non-contact moistening apparatus that effects controlled and accurate moistening of an object. Hollow rotor means is provided having at least one shaped portion in its surface, that portion having a row of nozzles therein. The nozzles are drilled completely through the rotor means sidewall so that they comprise a conduit between the rotor's center and the outer surface thereof. An apertured plate, having a slot cut therein, and a shutter plate are movably mounted with respect to each other between an object to be coated and the rotor means. Fluid is delivered to the center of the rotor from a supply thereof by means of an inlet tube inserted through one end thereof. The rotor is coupled at its other end, both of which are sealed to prevent the escape of fluid, to a motor and driven thereby to forcibly eject fluid from the nozzles, aided by the vacuum effect of the shaped rotor surface portion. Only that fluid escaping through the exposed section of the slot in the apertured plate strikes and thereby coats the object to be moistened. Movement of the shutter plate, relative to the slot of the aperture plate, can be used to incrementally adjust the width and number of layers of fluid applied to the moistened object.

BRIEF DESCRIPTION OF THE DRAWINGS

The invention will be described further, by way of a preferred example thereof, with reference to the accompanying drawings wherein like reference numerals have been used in the several views to depict like elements, in which:

FIG. 1 depicts an isometric view of moistening apparatus implemented in accordance with the present invention; and FIG. 2 schematically illustrates a simplified representation of moistening apparatus implemented in accordance with the present invention in the operating environment of an electrolytic printer for use in wetting the surface of a recording medium therein.

DESCRIPTION OF THE PREFERRED EMBODIMENT

The basic configuration necessary to apply moisture to an object, in this instance the surface layer of the recording medium in an electrolytic printer, is shown in FIG. 1. This configuration includes a hollow cylindrical rotor 10 having a center portion 11 and sidewall 13. The rotor 10 is fabricated from aluminum, stainless steel or other suitable material that would be impervious to and depend upon the operating environment. Rotor 10 is provided with at least one shaped section 15 having a flat portion 17 and a rounded portion 19. The rotor is provided with a plurality of nozzles 20 drilled completely through its sidewall 13 to form a longitudinal row in the flat portion 17 of the shaped section 15. If desired, rotor 10 can be provided with an additional shaped section and an additional row of nozzles, as shown in FIGS. 1 and 2, as an optional feature. The rotor 10, as shown in FIG. 1, is coupled to and rotatably driven by a DC motor 12. Rotor 10 is sealed at the end to which motor 12 is connected to prevent the egress of fluid therefrom.

An apertured plate 14 and shutter plate 16 are mounted between the rotor 12 and the object to be moistened. The apertured plate 14 is provided with a slot 21 of length 'l' and width 'd'. The length 'l' of slot 21 is at least slightly shorter than the length 'L' of rotor 10. Slot 21 is depicted as rectangular in shape, but that can be changed to accommodate any particular requirement. The shutter plate 16 is movably mounted with respect to the aperture plate 14 so that it can cover any portion of slot 21 that is desired. This renders shutter plate 16 capable of facilitating or restricting the passage of fluid through slot 21. Alternatively, both plates 14 and 16 can be movably mounted or just the aperture plate 14 can be movably mounted. The important aspect of the plate mounting arrangement is that they be movable with respect to each other.

In operation, as is best shown in FIG. 2, rotor 10 is spun by motor 12 at approximately 4000 to 12000 rpm, preferably at 5000 rpm. Fluid is supplied through an inlet tube 18 to the center 11 of rotor 10. Inlet tube 18 is connected to a source of fluid, which is delivered therethrough to the interior of rotor 10 by a pump of conventional design (not shown). The fluid passes from the rotor core 11 through the nozzles 20 and is emitted therefrom in the shaped section 15 of the rotor surface. The milled out scallop 19 on the rotor surface creates a partial vacuum which allows the fluid exiting nozzles 20 to rise higher above rotor 10 than it would were the rotor surface perfectly smooth. The. curved portion 19 of shaped section 15 serves to block or force fluid back into the wetting zone above the nozzles 20.

The fluid is continuously emitted from rotor 10, although some type of intermittent operation would be possible. In the wetting zone, beneath the slot 21, the fluid that escapes from nozzles 20 rises through the slot 21 in a thin layer 23, one per revolution for each row of nozzles present, and is deposited on the exposed surface of the object being moistened, in this case, the recording medium of an electrolytic printer. As previously noted, the shutter 16 is capable of being moved relative to the aperture plate 14, in any direction, to thereby dictate the fluid layer pattern that is deposited on the object being moistened. Thus, the exposed portion of slot 21, having area 'a', allows a fluid layer 23 of the same area and configuration to pass for each revolution of rotor 10, for each row of nozzles 20 present. The recording medium or object to be coated is moved across the top of slot 21 at a fixed speed consistent with the process it is involved in.

Coating coverage on the moistened object is controlled by adjusting one or more of the following:

(a) effective width and/or length of slot 21;
(b) rotor speed;
(c) speed of the object to be moistened;
(d) nozzle geometry, and
(e) number of rows of nozzles.

By fixing rotor speed and recording medium speeds, single incremental layers 23 of fluid of differing area can be obtained by simply adjusting the effective area of slot 21, that area left open after movement of the shutter plate 16, relative to aperture plate 14, is completed. For example, using a single row of nozzles, a rotor speed of 5000 rpm and a recording medium speed of 10 inches per second results in a single layer 23 of fluid of width 'd' being applied at 'd' inch intervals to the surface of the recording medium. If 'd' is doubled, the coating is applied twice, as the operative row of nozzles is rotated into the wetting zone twice before the area to be moistened is moved therefrom, for this example. Similarly, if 'd' is trebled or quadrupled, the coating is applied three or four times. If 'd' is set at $\frac{1}{8}''$, then a single layer of moisture is applied to the object to be coated. If 'd' is fixed at $\frac{1}{4}''$, then two layers are applied and, in a like manner, three layers are applied when 'd' is set at $\frac{3}{8}''$ and four layers result from 'd' expanding to $\frac{1}{2}''$. Thus, it is possible to employ the present invention to provide precise increments of fluid, of a predetermined number of layers 23, to an object to be moistened by a simple, non-precision adjustment of slot 21. Since each layer 23 is rather thin, this apparatus yields a precise coating thickness by incrementing 'd' in steps of $\frac{1}{8}''$.

After the fluid exits nozzles 20, any not escaping via slot 21 strikes the underside of plates 14 and 16 or the walls 22 and is returned to a liquid reservoir 28 via the slopped floor 24. Since the described apparatus is a non-contact coating system, the fluid supply 28 is not in danger of being contaminated by chemicals on or in the surface of the object being moistened and could conveniently be used as the liquid source. In addition, it is important to note that the non-contact feature of the present invention eliminates the drag to the recording medium transport system found in such arrangements as that exemplified in the Pawletko patent mentioned above. It exhibits fast start/stop characteristics when a solenoid is used to provide remote adjustment capability for shutter plate 16 adjustment. Furthermore, if desired, a second shaped rotor surface section 15 can be added, preferably diametrically opposite to the first.

Although the present invention has been described in the context of a preferred embodiment thereof, it will be readily apparent to those skilled in the appertaining art, that modifications and variations can be made therein without departing from its spirit and scope. Accordingly, it is not intended that the present invention be limited to the specifics of the foregoing description of the preferred embodiment. Instead, the present invention should be considered as being limited solely by the appended claims, which alone are intended to define its scope.

Having thus described our invention, what we claim as new and desire to secure by Letters Patent, is as follows:

1. Apparatus for wetting the surface of an object with predetermined amounts of fluid to thereby render it amenable to a future operation to be performed thereon, said apparatus comprising;

(a) a source of fluid;

(b) a cylindrical rotor having a hollow center and a shaped surface portion for causing a partial vacuum thereabove when said rotor is rotated, said shaped surface portion having at least one row of apertures therein, said apertures forming a path from said rotor center to said shaped surface portion of said rotor, (c) conduit means, connected between said liquid source and said rotor center, for conveying fluid from said source thereof to said rotor center;

(d) shutter means, adjustably mounted between said row of apertures and said object to be wetted, for selectively blocking the amount of fluid applied to said object; and (e) drive means, connected to said rotor, for rotating said rotor when energized to thereby force fluid from its center, through said apertures and, as permitted, said shutter means onto the surface of said object to be wetted.

2. The apparatus according to claim 1 wherein said shaped surface portion of said rotor comprises a flat section, wherein said apertures are formed, and a curved section.

3. The apparatus according to claim 2 wherein said curved section of said shaped surface portion of said rotor includes a concave segment that faces in the direction of rotation of said rotor.

4. The apparatus according to claim 1 wherein said shutter means includes a shutter plate and an apertured plate having a slot of predetermined shape formed therein, said plates being movably mounted with respect to one another, and said shutter means being mounted so that said slot is positioned between said row of apertures and said object to be wetted.

5. The apparatus according to claim 4 wherein said shaped surface portion of said rotor comprises a flat section, wherein said apertures are formed, and a curved section.

6. The apparatus according to claim 5 wherein said curved section of said shaped surface portion of said rotor includes a concave segment that faces in the direction of rotation of said rotor.

7. The apparatus according to claim 1 wherein said rotor includes at least a second shaped surface portion placed 180 degrees away from the other shaped surface portion.

8. The apparatus according to claim 7 wherein said shaped surface portions of said rotor comprise a flat section, wherein said apertures are formed, and a curved section.

9. The apparatus according to claim 8 wherein said curved sections of said shaped surface portions of said rotor include a concave segment that faces in the direction of rotation of said rotor.

* * * * *